US009505666B2

(12) United States Patent
Deppert et al.

(10) Patent No.: US 9,505,666 B2
(45) Date of Patent: Nov. 29, 2016

(54) METHODS TO DESENSITIZE HYDRAZINIUM NITROFORMATE (HNF)

(71) Applicant: RAYTHEON COMPANY, Waltham, MA (US)

(72) Inventors: Thomas M. Deppert, Tucson, AZ (US); David R. Smith, Tucson, AZ (US); Carl Shanholtz, Fort Ashby, WV (US)

(73) Assignee: RAYTHEON COMPANY, Waltham, MA (US)

( * ) Notice: Subject to any disclaimer, the term of this patent is extended or adjusted under 35 U.S.C. 154(b) by 60 days.

(21) Appl. No.: 14/268,470

(22) Filed: May 2, 2014

(65) Prior Publication Data

US 2015/0315093 A1 Nov. 5, 2015

(51) Int. Cl.

| | |
|---|---|
| ***C06B 45/18*** | (2006.01) |
| ***C06B 45/30*** | (2006.01) |
| ***C06B 45/32*** | (2006.01) |
| ***C06B 45/34*** | (2006.01) |
| ***D03D 23/00*** | (2006.01) |
| ***D03D 43/00*** | (2006.01) |
| ***C06B 45/10*** | (2006.01) |
| ***C06B 25/36*** | (2006.01) |
| ***C06B 47/08*** | (2006.01) |

(52) U.S. Cl.

CPC ..... *C06B 45/10* (2013.01); *C06B 25/36* (2013.01); *C06B 45/32* (2013.01); *C06B 47/08* (2013.01)

(58) Field of Classification Search

USPC ..... 149/7, 3, 5, 6, 108.8, 109.4, 109.6

See application file for complete search history.

(56) References Cited

U.S. PATENT DOCUMENTS

| | | | | |
|---|---|---|---|---|
| 3,242,021 | A * | 3/1966 | D'Alelio | C06B 45/105 149/19.2 |
| 3,418,183 | A | 12/1968 | Rice | |
| 3,537,922 | A | 11/1970 | Gilman et al. | |
| 3,963,511 | A | 6/1976 | Swift et al. | |
| 3,963,512 | A | 6/1976 | Swift et al. | |
| 4,073,766 | A | 2/1978 | Fein et al. | |
| 4,389,263 | A | 6/1983 | Allen | |
| 4,915,755 | A * | 4/1990 | Kim | C06B 45/10 149/19.4 |
| 4,944,815 | A * | 7/1990 | Consaga | C06B 45/10 149/19.1 |
| 5,336,343 | A | 8/1994 | Hamilton et al. | |
| 5,837,930 | A * | 11/1998 | Mul | C06B 25/00 149/19.4 |
| 2002/0157557 | A1 | 10/2002 | Cesaroni et al. | |
| 2008/0262163 | A1 | 10/2008 | Bae | |

FOREIGN PATENT DOCUMENTS

| | | |
|---|---|---|
| GB | 923718 | 4/1963 |
| WO | 9301151 A1 | 1/1993 |

OTHER PUBLICATIONS

Cui R-X, et al.; "Mechanism of Boic-Acid-Ester Bonding Agent in AP/RDX/AI/HTPB Propellant", Journal of Propulsion Technology; 1 page; Aug. 2010; Abstract.

(Continued)

*Primary Examiner* — James McDonough
(74) *Attorney, Agent, or Firm* — Cantor Colburn LLP

(57) ABSTRACT

Disclosed herein are energetic compositions and methods of making thereof. A composition includes hydrazinium nitroformate (HNF) particles dispersed in a polymeric binder and a bonding agent bonded to a surface of at least a portion the HNF particles. The bonding agent disclosed is a Lewis acid.

15 Claims, 1 Drawing Sheet

(56) References Cited

OTHER PUBLICATIONS

International Search Report and Written Opinion dated Jul. 13, 2015 for Application No. PCT/US2015/017097.
International Search Report and Written Opinion dated Jul. 13, 2015 for Application No. PCT/US2015/017099.
Li, Fan, et al.; "Synthesis of Boron-Containing Coupling Agents and Its Effect on the Interfacial Bondin of Fluoropolymer/TATB Composite"; Journal of Applied Polymer Science; vol. 105; p. 777-782; 2007.

* cited by examiner

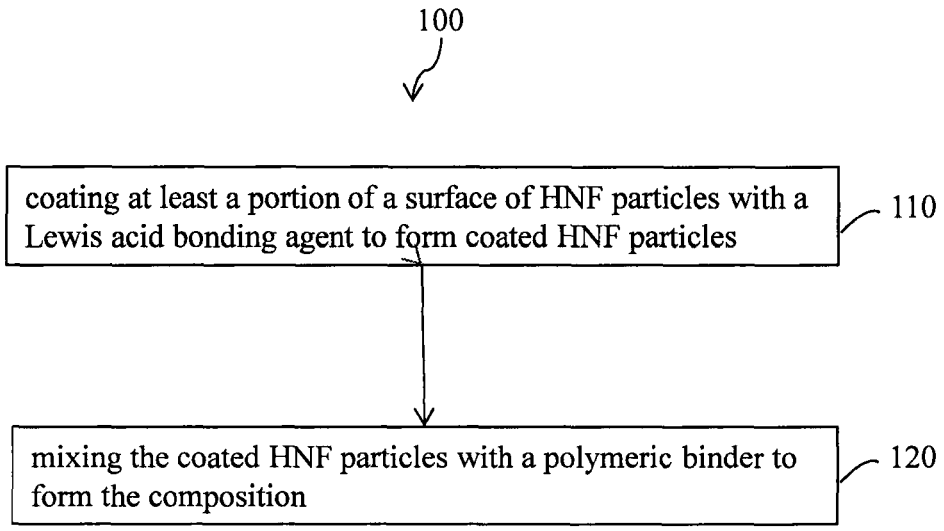
100
coating at least a portion of a surface of HNF particles with a Lewis acid bonding agent to form coated HNF particles
110
mixing the coated HNF particles with a polymeric binder to form the composition
120

METHODS TO DESENSITIZE HYDRAZINIUM NITROFORMATE (HNF)

BACKGROUND

The present disclosure relates to energetic compositions, more specifically to bonding agents for hydrazinium nitroformate (HNF) compositions.

Energetic compositions, for example composite solid rocket propellants and composite propellants, include solid particles dispersed in a rubbery matrix, called a binder. A compound that provides oxidizing chemical species to the combustion process and/or liberates energy upon decomposition is a common type of particle used in solid propellant compositions. The structural properties of the energetic composition are influenced by the strength of the bond between the binder and the surfaces of the solid particles. Since the oxidizers can make up a majority of the particulate matter, the bond between the binder and the oxidizer particle surfaces has a significant effect on composition's structural properties.

Ammonium perchlorate (AP) is a common oxidizer used in energetic compositions and chemically reacts with many types of compounds. A number of effective bonding agents exist for energetic compositions in which AP is the principal oxidizer. However, effective bonding agents for energetic compositions in which nitrogen-containing oxidizers, which are less reactive, are the principal solid oxidizer are unknown. Two common nitrogen-containing oxidizers used in energetic compositions are cyclotetramethylenetetranitramine (HMX) and cyclotrimethylenetrinitramine (RDX).

Generally, an effective bonding agent will coat the oxidizer surface, react to form an encapsulating film around the particles, and bond to the binder either chemically or adhesively. If the bonding agent film has sufficient affinity for the oxidizer surface, it will prevent binder/oxidizer separation under stress. The bonding agent may be coated onto the oxidizer particles either before incorporation of the oxidizer into the composition mix or, in some cases, during the composition mixing operation.

The structural properties of energetic compositions derive from a complex interaction of binder properties with the solid oxidizer particles. Further, the composition properties are strongly influenced by particle size and volumetric loading, as well as by the binder/solids bond strength. When the elastomeric binder is strong relative to the binder/solids bond strength, an energetic composition under sufficient tension will undergo separation of the binder from the solids. The separation is sometimes referred to as de-wetting or blanching and is followed by large extensions of the binder prior to rupture. Structurally, such an energetic composition is characterized by high extensibility and low tensile strength. However, when the binder/solids bond strength is increased, as by a bonding agent, de-wetting is prevented or forestalled, resulting in less extensibility and higher tensile strength.

Although effective bonding agents are known, AP poses environmental hazards. In particular, chlorine species are released in exhaust fumes, contaminating the surrounding air and groundwater.

HNF is a salt of the hydrazinium ion ($N_2H_5^+$) and nitroformate anion ($C(NO_2)_3^-$). HNF has the potential to serve as an improved, eco-friendly, oxidant in propellants. HNF produces energetic compositions which burn very rapidly and with very high combustion efficiency. Further, HNF's high energy leads to high specific impulse propellants. However, HNF suffers from poor handling sensitivity and incompatibility with known conventional binder systems.

SUMMARY

According to one embodiment, a composition includes hydrazinium nitroformate (HNF) particles dispersed in a polymeric binder and a bonding agent bonded to a surface of at least a portion the HNF particles. The agent is a Lewis acid.

In another embodiment, a composition includes HNF oxidizer particles dispersed in a polymeric binder and a Lewis acid bonding agent bonded to at least a portion of a surface the HNF particles to form an encapsulating film.

Yet, in another embodiment, a method of making a composition includes coating at least a portion of a surface of HNF particles with a Lewis acid bonding agent to form coated HNF particles and mixing the coated HNF particles with a polymeric binder to form the composition.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE SEVERAL VIEWS OF THE DRAWINGS

For a more complete understanding of this disclosure, reference is now made to the following brief description, taken in connection with the accompanying drawings and detailed description, wherein like reference numerals represent like parts:

FIG. 1 is block diagram of an exemplary method of making an energetic composition with a Lewis acid bonding agent.

DETAILED DESCRIPTION

Disclosed herein are HNF compositions with Lewis acid bonding agents and methods of making those compositions. In one embodiment, a composition includes HNF particles dispersed in a polymeric binder and a bonding agent bonded to a surface of at least a portion the particles. The bonding agent is a Lewis acid. In another embodiment, a composition includes HNF particles dispersed in a polymeric binder and a Lewis acid bonding agent bonded to at least a portion of a surface the HNF particles to form an encapsulating film. Yet, in another embodiment, a method of making a composition includes coating at least a portion of a surface of HNF particles with a Lewis acid bonding agent to form a coated nitrogen-containing oxidizer and mixing the coated HNF particles with a polymeric binder to form the composition.

The following definitions and abbreviations are to be used for the interpretation of the claims and the specification. As used herein, the terms "comprises," "comprising," "includes," "including," "has," "having," "contains" or "containing," or any other variation thereof, are intended to cover a non-exclusive inclusion. For example, a composition, a mixture, process, method, article, or apparatus that comprises a list of elements is not necessarily limited to only those elements but can include other elements not expressly listed or inherent to such composition, mixture, process, method, article, or apparatus.

As used herein, the articles "a" and "an" preceding an element or component are intended to be nonrestrictive regarding the number of instances (i.e. occurrences) of the element or component. Therefore, "a" or "an" should be read to include one or at least one, and the singular word form of the element or component also includes the plural unless the number is obviously meant to be singular.

As used herein, the terms "invention" or "present invention" are non-limiting terms and not intended to refer to any single aspect of the particular invention but encompass all possible aspects as described in the specification and the claims.

As used herein, the term "about" modifying the quantity of an ingredient, component, or reactant of the invention employed refers to variation in the numerical quantity that can occur, for example, through typical measuring and liquid handling procedures used for making concentrates or solutions. Furthermore, variation can occur from inadvertent error in measuring procedures, differences in the manufacture, source, or purity of the ingredients employed to make the compositions or carry out the methods, and the like. In one aspect, the term "about" means within 10% of the reported numerical value, or within 5% of the reported numerical value.

As used herein, the terms "percent by weight," "% by weight," and "wt. %" mean the weight of a pure substance divided by the total weight of a compound or composition, multiplied by 100. Typically, "weight" is measured in grams (g). For example, a composition with a total weight of 100 grams, which includes 25 grams of substance A, will include substance A in 25% by weight.

As used herein, the term "energetic composition" means a mixture including HNF, a polymeric binder, a Lewis acid bonding agent, and optionally, other additives (e.g., additional fuel). The energetic composition is burned to produce thrust in objects and vehicles, including rockets. Nonlimiting examples of energetic compositions include propellants and explosives.

As used herein, the term "hydrazinium nitroformate" and "HNF" means a salt of the hydrazinium cation ($N_2H_5^+$) and nitroformate anion ($C(NO_2)_3^-$). The hydrazinium cation has a nitrogen atom with a lone pair of electrons that can function as a Lewis base.

As used herein, the term "nitrogen-containing oxidizer" means a compound, substance, monomer, polymer, copolymer, or material that includes nitrogen and can donate, liberate, or release oxygen and/or electrons. Nitrogen-containing oxidizers disclosed herein are Lewis bases and can therefore donate a pair of electrons to a Lewis acid to form a Lewis adduct.

As used herein, the term "bonding agent" means a compound, substance, monomer, polymer, copolymer, or material that interfaces with the surfaces of HNF particles in an energetic composition. The bonding agents disclosed herein are Lewis acids. The bonding agent reacts and bonds chemically or adhesively with the surfaces of HNF. During curing, the bonding agent reacts with a polymeric binder.

As used herein, the term "Lewis acid" means a molecule, compound, monomer, polymer, copolymer, or chemical species that is an electron-pair acceptor and therefore able to react with a Lewis base to form a Lewis adduct by sharing the electron pair furnished by a Lewis base, for example nitrogen or oxygen.

As used herein, the term "polymeric binder" means an elastomeric polymer or copolymer which spatially immobilizes particulates of high-energy material, including fuel material particulates and oxidizer particulates.

As used herein, the term "fuel" means a substance that burns when combined with oxygen producing gas for propulsion.

Solid propellants are used extensively in the aerospace industry. For example, solid propellants are common methods of powering missiles and rockets for military, commercial, and space applications. Solid rocket motor propellants are widely used because they are relatively simple to manufacture and use. Further, solid rocket propellants have excellent performance characteristics.

Energetic compositions can be formulated using an oxidizing agent (oxidizer), a fuel, and a binder. At times, the binder and the fuel may be the same. In addition to these basic components, various bonding agents, plasticizers, curing agents, cure catalysts, and other similar materials which aid in the processing, curing of the energetic composition, or contribute to mechanical properties of the cured composition can be added.

Many energetic composition used in the aerospace industry incorporate ammonium perchlorate (AP) as the oxidizer, which is generally incorporated in particulate form. In order to hold the composition in a coherent form, the components of the composition are bound together by a polymeric binder, such as a hydroxy-terminated polybutadiene (HTPB) binder. Such binders are widely used and commercially available. Compositions dispersed in a suitable binder are easy to manufacture and handle, have good performance characteristics, and are economical and reliable. As a result, this type of solid composition has become a standard in the industry.

Energetic compositions must generally meet various mechanical and chemical performance criteria to be considered acceptable for routine use. For example, the composition must have desired mechanical characteristics which allow it to be used in a corresponding rocket or missile. Further, the composition must elastically deform during use to avoid cracking within the propellant grain.

If the composition cracks, burning within the crack may be experienced during operation of the rocket or missile. Burning in a confined area may result in an increased surface area of burning composition or increased burn rate at a particular location. This increase in the burn rate and surface area can directly result in failure of the rocket motor due to over pressurization or burning through of the casing. Accordingly, energetic compositions are typically subjected to standardized stress and strain tests. Data is recorded during such tests and objective measures of stress and strain performance are provided.

To make certain that formulations meet the applicable specifications, it is often necessary to employ a bonding agent within the composition. Bonding agents are widely used throughout the solid propellant industry to strengthen the polymeric binder matrix which binds the oxidizer and fuel together. Bonding agents aid in incorporating solid oxidizer particles into the polymeric binder system. Using a bonding agent typically improves the stress and strain characteristics of the composition.

Bonding agents are components of energetic formulations that affect processing, mechanical properties, ballistics, safety, aging, temperature cycling, and insensitive munitions (IM) propellant characteristics. IM refers to requirements for new munitions to be less susceptible to unintended ignition or explosion. IM can be defined by Military Standard MIL-STD-2105D. Bonding agents improve propellant processing, enabling higher solids loading (e.g., up to 88% solids) by wetting the solids, improving stress-strain curves, and eliminating de-wetting (voids and micro porosity) in the propellant.

Approximately 80% of solid rocket propellants utilize AP as the oxidizer. AP is advantageous because it produces stable versatile propellants and has well-developed bonding agents. However, AP is environmentally unfriendly and produces corrosive gases in plume. However, current AP replacements demonstrate reduced performance compared to AP.

Nitrogen-based oxidizers are another class of known oxidizing compound used in critical applications. Examples of nitrogen-containing oxidizers include ammonium nitrate (AN) and nitramines, such as cyclotetramethylenetetranitramine (HMX) and cyclotrimethylenetrinitramine (RDX). Nitrogen-based oxidizers have several advantages, including being clean-burning, environmentally friendly, and having higher and lower burn possible burn rates. Despite these advantages, nitrogen-containing oxidizers may have poor mechanical properties and processing difficulties in absence of effective bonding agents. Known bonding agents, for example for AP, will not react with the surface of nitrogen-containing oxidizers. Further, nitrogen-containing oxidizers have a lower overall reactivity.

Energetic compositions based on nitrogen-containing oxidizers thus typically do not include a bonding agent and thus, may not possess the high stress and high strain capabilities of AP based compositions. Absence of bonding agents therefore limits their application for use in complex mechanical systems.

HNF is a nitrogen-containing oxidizer that has the potential to serve as a novel, improved, eco-friendly oxidant in energetic compositions. HNF would also provide improved ballistic performance compared to AP. However, HNF suffers from poor handling sensitivity. Further, HNF is incompatible with conventional HTPB binder systems because it will react with the binder. Currently, there are no known bonding agents known for HNF.

Accordingly, disclosed herein is a suitable bonding agent to desensitize HNF, making it a suitable agent for energetic compositions. The bonding agents disclosed herein are Lewis acids. The Lewis acid bonding agents thus solve the binder compatibility problem for HNF compositions.

The disclosed compositions generally improve motor performance and thus can be used in a variety of applications, including missile defense, land combat, and air-to-air applications. The energetic compositions will increase the energetics trade space by enabling long-term replacement of AP with eco-friendly HNF in rocket motors. The inventive compositions can be used as energetics in the mining and construction industries, as solid propellants in aerospace applications, and in energetic-based safety systems.

The surface of HNF particles are coated with the Lewis acid bonding agents. In particular, the Lewis acid bonding agents may be chemically bonded to the HNF particles to form an encapsulating film. The bonded HNF particles are then reacted with the binder to form a chemical or adhesive bond between the oxidizer and the binder. The resulting material is stabilized by reducing the shock and electrostatic discharge sensitivity.

Bonding agents are Lewis acids containing substituent groups that react with the lone pair of electrons on the nitrogen atom of HNF. Lewis acids are monomers or polymers that chemically, or adhesively, interact, bond, or react with the surface of HNF oxidizer to encapsulate the oxidizer. The resulting encapsulated oxidizer will have improved wetting properties and become an integral part of the polymeric binder network. Thus, integrating the Lewis acid bonding agent into a composition of HNF will improve the processing, mechanical properties, ballistics, safety, aging, temperature cycling, and IM characteristics.

The energetic compositions disclosed herein include particles of HNF dispersed in a polymeric binder and a bonding agent bonded to a surface of at least a portion the particles. The bonding agent is a Lewis acid, which acts as an electron-pair acceptor and forms a bond with the lone-pair of the nitrogen atom of HNF.

HNF includes hydrazine cations and nitroformate anions. The molar ratios of hydrazine and nitroformate can be in a range from about 0.99:1 to 1:0.99. In one embodiment, the HNF includes hydrazine and nitroformate in approximately equimolar ratios. In another embodiment, the HNF composition contains substantially no hydrazine or nitroformate in unreacted form.

Optionally, the disclosed compositions including HNF can include any additional oxidizers, including other nitrogen-containing oxidizers. Nitrogen-containing oxidizers are not intended to be limited and include any oxidizing compound suitable for energetic compositions which has a lone pair of electrons that can function as a Lewis base and/or donate oxygen. Non-limiting examples of nitrogen-containing oxidizers include chlorates, perchlorates, peroxides, nitrates, nitrites, and permanganates. Further, non-limiting examples of suitable nitrogen-containing oxidizers include triaminoguanidinium azide, diaminoguanidinium azide, monoaminoguanidium azide, monoaminoguanidine, diaminoguanidine, triaminoguanidine, aminotetrazole, diaminotetrazole, 4 amino-3,5-dihydrazino-1,2,4(4H)-triazole, dihydrazinotetrazine, or any combination thereof. The nitrogen-containing oxidizers can be homopolymers or copolymers of the aforementioned monomers and compounds. Other suitable nitrogen-containing oxidizers to be employed are the high nitrogen containing polymers prepared by condensing one or a mixture of the hereinbefore listed amines with a formaldehyde or glyoxal based material. Still, other suitable polymeric nitrogen-containing oxidizer materials include the poly(guanidines), poly(amino-substituted guanidines), poly(guanidinium azides), and poly (amino-substituted guanidinium azides). Further, non-limiting examples of suitable nitrogen-containing oxidizers include RDX, HMX, AN, ammonium dinitramide (AND), nitrogen tetroxide (NTO), and the like, or any combination thereof.

Generally, the HNF and other nitrogen-containing oxidizers are in the form of solid particles. The average diameter of the particles can be in a range between about 5 and about 200 microns. The HNF and nitrogen-containing oxidizer particles can have an average diameter in a range between about 50 and about 100; between 25 and about 125; or between 100 and about 180 microns. In one aspect, the HNF and nitrogen-containing oxidizer particles have an average diameter about or in any range between about 5, 10, 20, 30, 40, 50, 60, 70, 80, 90, 100, 110, 120, 130, 140, 150, 160, 170, 180, 190, and 200 microns.

The HNF is present in the composition in an amount in a range between about 50 and about 80 wt. %. In other embodiments, the HNF is present in the composition in amount in a range between about 60 and about 80 wt. %; between about 55 and about 75 wt. %; between about 70 and about 80 wt. %; or between about 50 and about 70 wt. %. In one embodiment, the HNF is present about or in any range between about 50, 55, 60, 65, 70, 75, and 80 wt. %.

The bonding agent is a Lewis acid that reacts with at least a portion of the surface of the HNF to form a chemical or adhesive bond. The Lewis acid can chemically bond with the surface of the particles to form an encapsulating film. Then, during subsequent curing of the composition, the bonding agent reacts with the binder.

The bonding agent of the present invention is any Lewis acid that can react with, form a chemical bond with, or form an adhesive bond with the HNF. The Lewis acid bonding agent can be, for example, a boron compound that forms a stable adduct with the HNF. The Lewis acid can be a boron-containing compound, a boron-containing monomer, a boron-containing polymer, or a boron-containing copolymer.

Lewis acids can be boron halides, such as $BF_3$, $BCl_3$, and $BBr_3$; antimony pentachloride ($SbF_5$); aluminum halides ($AlCl_3$ and $AlBr_3$); titanium halides such as $TiBr_4$, $TiCl_4$, and $TiCl_3$; zirconium tetrachloride ($ZrCl_4$); phosphorus pentafluoride ($PF_5$); iron halides such as and $FeBr_3$; and the like. Other Lewis acids include metal cations, for example, tin, indium, bismuth, zinc, lithium, sodium, zinc, and materials including thereof. Enone compounds are suitable Lewis acids (e.g., methyl vinyl ketone). Enone compounds include any chemical compound or functional group consisting of a conjugated system of an alkene and a ketone. Any monomer or polymer containing an atom or group that acts as a Lewis acid and can bond to nitrogen-containing oxidizers may be used. Non-limiting examples of suitable enone compounds include 1-buten-2-one; 1-penten-3-one; 4-methyl-4-phenyl-cyclohex-2-enone; 4,4-diphenyl-cyclohex-2-enone; and 4,4-(dimethylcyclohex-2-en-1-one)-2-boronic acid, pinacol ester having the following structure:

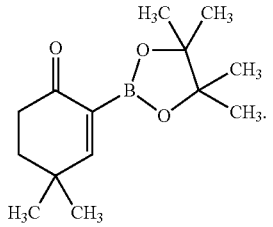

The Lewis acid can be a boron-containing compound or monomer having the following structure:

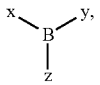

wherein x, y, and z are each independently a hydrogen, an acrylate group, an acyl halide group, an amide group, an amine group, a carboxylate group, a carboxylate thiol group, an ester group, an ether group, a hydroxamic acid group, a hydroxyl group, a nitrate group, a nitrile group, a phosphate group, a phosphine group, a phosphonic acid group, a silane group, a sulfate group, a sulfide group, a sulfite group, a thiolate group, an alkane group, an alkene group, an alkyne group, an aryl group, an azide group, an acetal group, an aldehyde group, a diene group, a 3-membered ring group, 4-membered ring group, a 5-membered ring group, or a 6-membered ring group, or any combination thereof. Any of the foregoing groups can be substituted, functionalized, combined and can include 1, 2, 3, 4, 5, 6, 7, 8, 9, or 10 carbons.

In an exemplary embodiment, the Lewis acid has the following structure:

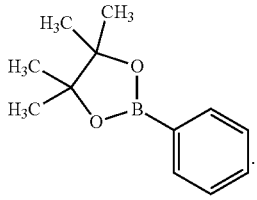

In another embodiment, the Lewis acid has the following structure:

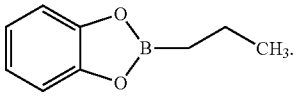

The Lewis acid can be a boron-containing polymer having the following structure:

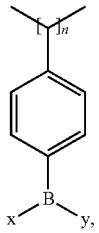

wherein n is an integer from 1 to 20, and x and y are each independently a hydrogen, an acrylate group, an acyl halide group, an amide group, an amine group, a carboxylate group, a carboxylate thiol group, an ester group, an ether group, a hydroxamic acid group, a hydroxyl group, a methacrylate group, a nitrate group, a nitrile group, a phosphate group, a phosphine group, a phosphonic acid group, a silane group, a sulfate group, a sulfide group, a sulfite group, a thiolate group, an alkane group, an alkene group, an alkyne group, an azide group, an acetal group, an aldehyde group, a diene group, an anhydride group, a 3-membered ring group, 4-membered ring group, a 5-membered ring group, or a 6-membered ring group, or any combination thereof. Any of the foregoing groups can be substituted, functionalized, combined and can include 1 to 20 carbons. Optionally, n is an integer greater than 1, 2, 5, 10, or 15. In an exemplary embodiment, n is or in any range between about 1, 2, 3, 4, 5, 6, 7, 8, 9, 10, 11, 12, 13, 14, 15, 16, 17, 18, 19, and 20.

For example, the boron-containing polymer can have the following structure:

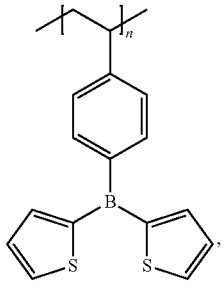

wherein n is a value from about 1 to about 20. In an exemplary embodiment, n is or in any range between about 1, 2, 3, 4, 5, 6, 7, 8, 9, 10, 11, 12, 13, 14, 15, 16, 17, 18, 19, and 20.

In one embodiment, the boron-containing polymer has the following structure:

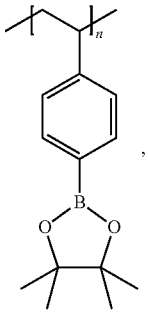

wherein n is a value from about 1 to about 20. In an exemplary embodiment, n is or in any range between about 1, 2, 3, 4, 5, 6, 7, 8, 9, 10, 11, 12, 13, 14, 15, 16, 17, 18, 19, and 20.

In another embodiment, the boron-containing polymer has the following structure:

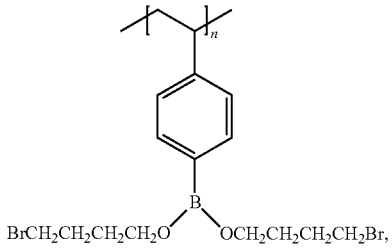

wherein n is a value from about 1 to about 20. In an exemplary embodiment, n is or in any range between about 1, 2, 3, 4, 5, 6, 7, 8, 9, 10, 11, 12, 13, 14, 15, 16, 17, 18, 19, and 20.

Yet, in another embodiment, the boron-containing polymer has the following structure:

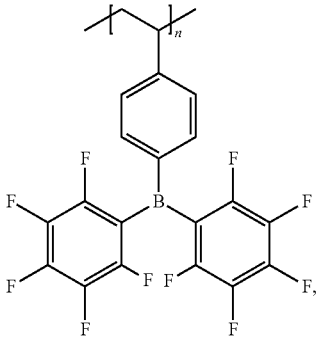

and n is a value from about 1 to about 20. In an exemplary embodiment, n is or in any range between about 1, 2, 3, 4, 5, 6, 7, 8, 9, 10, 11, 12, 13, 14, 15, 16, 17, 18, 19, and 20.

The Lewis acid can be a boron-containing copolymer having the following structure:

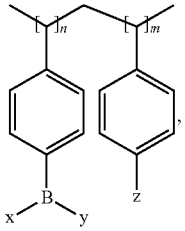

wherein n is an integer from 1 to 20, m is an integer from 1 to 20, and x, y, and z are each independently a hydrogen, an acrylate group, an acyl halide group, an amide group, an amine group, a carboxylate group, a carboxylate thiol group, an ester group, an ether group, a hydroxamic acid group, a hydroxyl group, a methacrylate group, a nitrate group, a nitrile group, a phosphate group, a phosphine group, a phosphonic acid group, a silane group, a sulfate group, a sulfide group, a sulfite group, a thiolate group, an alkane group, an alkene group, an alkyne group, an azide group, an acetal group, an aldehyde group, a diene group, an anhydride group, a 3-membered ring group, 4-membered ring group, a 5-membered ring group, or a 6-membered ring group, or any combination thereof. Any of the foregoing groups can be substituted, functionalized, combined and can include 1 to 10 carbons. In an exemplary embodiment, n and m are each independently or in any range between about 1, 2, 3, 4, 5, 6, 7, 8, 9, 10, 11, 12, 13, 14, 15, 16, 17, 18, 19, and 20.

In an exemplary embodiment, the boron-containing copolymer is a polystyrene copolymer having the following structure:

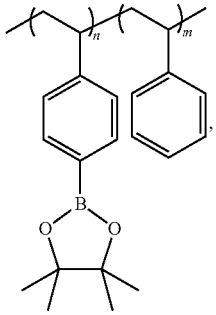

wherein n is an integer from 1 to about 20, and m is an integer from 1 to about 20. In an exemplary embodiment, n and m are each independently or in any range between about 1, 2, 3, 4, 5, 6, 7, 8, 9, 10, 11, 12, 13, 14, 15, 16, 17, 18, 19, and 20.

The molecular weight of the boron-containing polymer or copolymer can be in a range between about 200 and about 2,000. When polymerized with polystyrene, the boron-containing copolymers are soluble in common organic solvents, such as tetrahydrofuran (THF), dichloromethane (DCM), and toluene.

The bonding agent is present in the composition in an amount in a range between about 0.1 and about 1.0 wt. %. In other embodiments, the bonding agent is present in the composition in an amount in a range between about 0.1, 0.2, 0.3, 0.4, 0.5, 0.6, 0.7, 0.8, 0.9, and 1.0 wt. %.

The binder that holds together the components of the solid composite composition can be, e.g., a polymeric binder (i.e., a material that is polymerized to form solid binder), such as polyurethane or polybutadienes ($(C_4H_6)_n$), e.g., polybutadiene-acrylic acid (PBAA) or polybutadiene-acrylic acid terpolymer (such as polybutadiene-acrylic acid acrylonitrile (PBAN)); hydroxyl-terminated polybutadiene (HTPB), which can be cross-linked with isophorone diisocyanate; or carboxyl terminated polybutadiene (CTPB). Elastomeric polyesters and polyethers can also be used as binders. The binder is polymerized during rocket motor manufacture to form the matrix that holds the solid components together. The binder also is consumed as fuel during burning of the solid composite composition, which also contributes to overall thrust. The molecular weight of the polymeric binder can be in a range between about 600 and about 3,000 g/mol.

Optionally, additional fuel can be incorporated into the composition. The optional fuel can be a powder of at least one suitable metal or alloy, such as aluminum, beryllium, zirconium, titanium, boron, magnesium, and alloys and combinations thereof. The one or more metals can be pure metals. In exemplary embodiments, the powder particles can be micron sized, e.g., have a maximum dimension of 500 μm or less. Nano-scale powders having a maximum dimension of less than about 500 nm, such as less than about 300 nm or about 100 nm, can also be used. Depending on the composition, method of production, and subsequent processing of the metal powder, the metal powder can have various shapes, including spherical, flake, irregular, cylindrical, combinations thereof, and the like.

Optional stabilizers and processing aids (e.g., catalysts and curing agents) can be added to the solid composite energetic composition. These optional additives can include dibutyltin dilaurate, calcium stearate, carbon black and starch.

FIG. 1 illustrates block diagram of an exemplary method 100 of making the composition. In block 110, at least a portion of the surface of HNF particles are coated with a Lewis acid bonding agent to form coated HNF particles. The HNF and the Lewis acid bonding agent are dissolved and mixed in a suitable solvent. The solvent should be selected based on the dissolution properties of the Lewis acid. Non-limiting examples of suitable solvents include dichloromethane and toluene. Any suitable mixer can be used, for example a mixer with temperature and pressure control.

The Lewis acid bonding agent and HNF oxidizer are combined in proportions sufficient to create a thin molecular layer of the bonding agent on the surface of the HNF oxidizer. In block 120, the coated HNF is mixed with a polymeric binder to form the composition. The polymeric binder can be liquid, which can be mixed with suitable additives, such as plasticizers, antioxidants, stabilizers, or any combination thereof. Then the polymeric binder mixture is mixed with the Lewis acid coated HNF. The pressure of the mixture can be reduced during mixing and then subsequently vented to atmospheric pressure. Method 100 is but an exemplary embodiment. Other embodiments of method 100 can be used.

The blended Lewis acid bonded HNF and polymeric binder mixture is then cured. Curing converts the mixed material from a viscous fluid to a solid elastomer. Curing can be carried out with a polyisocyanate. During curing, the Lewis acid bonded HNF and polymeric binder are mixed at temperatures above room temperature. When polybutadiene is the binder, polyisocyanate forms polybutadiene during curing.

Non-limiting examples of polyisocyanates include isophorone diisocyanate (IPDI), dimeryl diisocyanate (DDI), methylene diphenyl diisocyanate (MDI), hexamethylene diisocycanate (HDI), or any combination thereof. Other polyisocyanates known for use in solid energetic formulations also can be used. The amount of polyisocyanate generally varies and depends on the structural requirements of the final product, as well as the type of isocyanate, the type and molecular weight of the polymer, and the amount of solids. In one embodiment, the amount of polyisocyanate used is in a range between about 0.5 and about 4 wt. % based on the total weight of the composition.

The composition is transferred to the desired end item (e.g., rocket motor, sample carton, etc.) and placed in a heated oven until cured. Curing conditions are selected such that an optimal energetic composition product is obtained by modifying temperature, curing time, catalyst type and catalyst content. A non-limiting of suitable conditions are curing times between about 3 and 14 days and temperatures between 30 and 70° C.

When additional fuel additives are included in the composition, the fuel additives are added prior to curing. Generally speaking, also minor proportions, for example up to no more than 2.5 wt. % of substances such as phthalates, stearates, copper or lead salts, carbon black, iron containing species, alumina, rutile, zirconium carbide, commonly used stabilizer compounds as applied for energetic compositions (e.g., diphenylamine, 2-nitrodiphenylamine, p-nitromethylaniline, p-nitroethylaniline and centralites) and the like are added to the compositions according to the invention. These additives are known to the skilled person and serve to increase stability, storage characteristics and combustion characteristics.

EXAMPLES

Constructive Example 1

A method for preparing the inventive HNF composition includes charging a stirred reactor with approximately 1,000 grams of suitable fluid, such as dichloromethane, and approximately 500 grams of the solid HNF oxidizer. The suitable fluid is a suitable solvent for the Lewis acid, not a solvent for the HNF. While stirring at room temperature, approximately 20 grams of the Lewis acid bonding agent bonding agent is added to the mixture. After about 1 hour, the fluid is removed by filtration or evaporation.

Then, a mixture of a liquid polymeric binder, (e.g., hydroxyl terminated polybutadiene (HTPB), glycidyl azide polymer (GAP), and various polyethers and polyesters known in the industry), plasticizer, and antioxidants or stabilizers is prepared and mixed in a mixer. While mixing, the Lewis acid coated HNF mixture is gradually added. After the Lewis acid coated HNF is well incorporated in the liquid mixture, the pressure of the mixture is reduced to approximately 15 mm Hg and continued to stir until the power draw of the mixer diminishes and stabilizes. Then, the stirring is stopped, and the mixer is vented to atmospheric pressure.

The mixer is restarted and a polyisocyanate of choice is added (e.g., isophorone diisocyanate (IPDI), dimeryl diisocyanate (DDI), methylene diphenyl diisocyanate (MDI), hexamethylene diisocycanate (HDI), or other various oligomers of HDI known in the industry). While mixing, the pressure is reduced to approximately 15 mm Hg. Then, the stirring is stopped, and the mixer is vented to atmospheric pressure. The composition is transferred to the desired end item (e.g., rocket motor, sample carton, etc.) and placed in a heated oven until cured. The cure times and temperatures can generally vary, although 7 days at 140° F. is representative.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated.

While the preferred embodiments to the invention have been described, it will be understood that those skilled in the art, both now and in the future, may make various improvements and enhancements which fall within the scope of the claims which follow. These claims should be construed to maintain the proper protection for the invention first described.

What is claimed is:

1. A composition comprising:

hydrazinium nitroformate (HNF) particles dispersed in a polymeric binder; and a bonding agent bonded to a surface of at least a portion the HNF particles;

wherein the bonding agent is a Lewis acid, and the Lewis acid is a boron-containing polymer having the following structure:

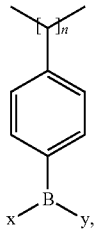

wherein n is an integer from 1 to 20, and x and y are each independently a hydrogen, an acrylate group, an acyl halide group, an amide group, an amine group, a carboxylate group, a carboxylate thiol group, an ester group, an ether group, a hydroxamic acid group, a hydroxyl group, a methacrylate group, a nitrate group, a nitrile group, a phosphate group, a phosphine group, a phosphonic acid group, a silane group, a sulfate group, a sulfide group, a sulfite group, a thiolate group, an alkane group, an alkene group, an alkyne group, an azide group, an acetal group, an aldehyde group, a diene group, an anhydride group, a 3-membered ring group, 4-membered ring group, a 5-membered ring group, or a 6-membered ring group, or any combination thereof.

2. The composition of claim 1, wherein the polymeric binder is a hydroxyl terminated polybutadiene, a glycidyl azide polymer, a polyether, a polyester, or any combination thereof.

3. The composition of claim 1, wherein the HNF particles comprise hydrazine and nitroformate in substantially equimolar ratios.

4. The composition of claim 1, wherein the bonding agent is bonded to the HNF particles with a chemical bond or an adhesive bond.

5. A composition comprising:

HNF oxidizer particles dispersed in a polymeric binder; and a Lewis acid bonding agent bonded to at least a portion of a surface the HNF particles to form an encapsulating film, wherein the HNF particles have an average diameter in a range between about 5 and about 200 microns.

6. The composition of claim 5, wherein the Lewis acid bonding agent is a boron-containing copolymer having the following structure:

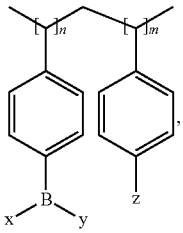

wherein n is an integer from 1 to 20, m is an integer from 1 to 20, and x, y, and z are each independently a hydrogen, an acrylate group, an acyl halide group, an amide group, an amine group, a carboxylate group, a carboxylate thiol group, an ester group, an ether group, a hydroxamic acid group, a hydroxyl group, a methacrylate group, a nitrate group, a nitrile group, a phosphate group, a phosphine group, a phosphonic acid group, a silane group, a sulfate group, a sulfide group, a sulfite group, a thiolate group, an alkane group, an alkene group, an alkyne group, an azide group, an acetal group, an aldehyde group, a diene group, an anhydride group, a 3-membered ring group, 4-membered ring group, a 5-membered ring group, or a 6-membered ring group, or any combination thereof.

7. The composition of claim 5, further comprising a polyisocyanate.

8. The composition of claim 5, wherein the Lewis acid bonding agent is an enone compound.

9. The composition of claim 8, further comprising a curing agent.

10. A method of making a composition, the method comprising:

coating at least a portion of a surface of HNF particles with a Lewis acid bonding agent to form coated HNF particles with the Lewis acid bonding agent bonded to at least a portion of the surface of the HNF particles to form an encapsulating film, the HNF particles having an average diameter in a range between about 5 and about 200 microns; and mixing the coated HNF particles with a polymeric binder such that the coated HNF particles are dispersed in the polymeric binder to form the composition.

11. The method of claim 10, wherein the Lewis acid bonding agent is a boron-containing monomer having the following structure:

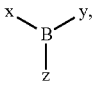

wherein x, y, and z are each independently a hydrogen, an acrylate group, an acyl halide group, an amide group, an amine group, a carboxylate group, a carboxylate thiol group, an ester group, an ether group, a hydroxamic acid group, a hydroxyl group, a methacrylate group, a nitrate group, a nitrile group, a phosphate group, a phosphine group, a phosphonic acid group, a silane group, a sulfate group, a sulfide group, a sulfite group, a thiolate group, an alkane group, an alkene group, an alkyne group, an azide group, an acetal group, an aldehyde group, a diene group, an anhydride group, a 3-membered ring group, 4-membered ring group, a 5-membered ring group, or a 6-membered ring group, or any combination thereof.

12. The method of claim 10, wherein the Lewis acid is a boron-containing polymer having the following structure:

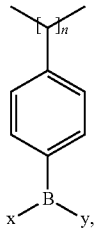

wherein n is an integer from 1 to 20, and x and y are each independently a hydrogen, an acrylate group, an acyl halide group, an amide group, an amine group, a carboxylate group, a carboxylate thiol group, an ester group, an ether group, a hydroxamic acid group, a hydroxyl group, a methacrylate group, a nitrate group, a nitrile group, a phosphate group, a phosphine group, a phosphonic acid group, a silane group, a sulfate group, a sulfide group, a sulfite group, a thiolate group, an alkane group, an alkene group, an alkyne group, an azide group, an acetal group, an aldehyde group, a diene group, an anhydride group, a 3-membered ring group, 4-membered ring group, a 5-membered ring group, or a 6-membered ring group, or any combination thereof.

13. The method of claim 10, wherein the HNF comprises hydrazine and nitroformate in a molar ratio in a range from about 0.99:1 to 1:0.99.

14. The method of claim 10, wherein the composition is a propellant or an explosive.

15. The method of claim 10, further comprising curing the composition.

* * * * *